US006059026A

United States Patent [19]

Bailly et al.

[11] Patent Number: 6,059,026

[45] Date of Patent: May 9, 2000

[54] DISTRIBUTOR FOR THE FILLING OF INTRATUBULAR HEAT EXCHANGERS OF COOLING INSTALLATIONS WITH A TWO-PHASE TYPE REFRIGERANT

[76] Inventors: André Bailly, Linod, 01260 Vieu; Romuald Jurkowski, 9, rue Millette, 01350 Culoz; Mohamed Idriss, 228 avenue Jean Jaurés, 92140 Clamart; Marc Altazin, chemin des Berthets, 73100 Brison-Saint-Innocent; Slimane Meziani, Z.I. Coron, 01300 Belley; Jean-Michel Navarro, Lotissement Chateau de Collonges, 73310 Ruffieux, all of France

[21] Appl. No.: 09/121,891

[22] Filed: Jul. 24, 1998

[30] Foreign Application Priority Data

Jul. 29, 1997 [FR] France ..... 97 09920

[51] Int. Cl.[7] ..... F28F 9/02

[52] U.S. Cl. ..... 165/174; 165/158; 62/525

[58] Field of Search ..... 165/174, 158; 62/525

[56] References Cited

U.S. PATENT DOCUMENTS

| | | | |
|---|---|---|---|
| 3,563,055 | 2/1971 | Owens . | |
| 3,623,505 | 11/1971 | Barsness . | |
| 5,059,226 | 10/1991 | Schneider et al. . | |
| 5,107,923 | 4/1992 | Sherman et al. | 165/174 X |

FOREIGN PATENT DOCUMENTS

| | | | |
|---|---|---|---|
| 322789 | 7/1920 | Germany | 165/174 |
| 3212914 | 10/1983 | Germany | 165/158 |
| 870905 | 10/1981 | U.S.S.R. | 165/174 |
| 3903 | 9/1880 | United Kingdom | 165/158 |

*Primary Examiner*—Leonard Leo
*Attorney, Agent, or Firm*—Dowell & Dowell, P.C.

[57] ABSTRACT

The distributor is constituted by a simple metal sheet (17) shaped as a spherical calotte that is provided with holes (17*b*) at its periphery and which is plane at the center. This plane element is preferably delimited by a conical body (17*a*).

4 Claims, 3 Drawing Sheets

DISTRIBUTOR FOR THE FILLING OF INTRATUBULAR HEAT EXCHANGERS OF COOLING INSTALLATIONS WITH A TWO-PHASE TYPE REFRIGERANT

BACKGROUND OF THE INVENTION

1. Field of the Invention

The present invention relates to cooling installations (refrigeration or air-conditioning) in which the cooling liquid to be cooled is processed inside a heat exchanger of intratubular type traversed by a two-phase refrigerant.

2. History of the Related Art

As very diagrammatically shown in FIG. 1 of the hereto accompanying illustrations, such an exchanger is generally available in the form of a cylindrical compartment 1, closed at each of its extremities by two end plates 2 and 3. Directly behind the end plate 3 is provided a transversal divider 4 with bore holes, being the space between the end plate 3 and this partition 4 divided by a diametrical wall 5 into two separate chambers, namely, an inlet chamber 6 and an outlet chamber 7, each of which chambers is provided with a conduit or tube 8 and 9, respectively, connected to a source of pressurized refrigerant.

The space 10 constituted between the partition 4 and the end plate 2 comprises a multitude of loop-shaped heat exchange tubes 11 or of rectilinear sections with elbows, the ends of which are inserted into the holes of the partition 4 so as to ensure the linkage between the chambers 6 and 7 for the circulation of the refrigerant. The cooling liquid (water or another fluid) is admitted into the space 10 of the compartment 1 by means of an inlet tube 12 and goes out through an outlet tube 13 after having been cooled by contact with the looped tubes 11.

Because of the two-phase nature of the used refrigerant (most frequently of the type known by its reference, R22), it is obviously necessary to provide adequate means to ensure the homogeneity of the liquid that fills that inlet chamber 6, so that the various tubes 11 are replenished in a steady manner. In practice, this result is obtained by providing inside the discharge of the tube 8 a two-phase distributor diagrammatically represented by A, generally of such type as shown in FIG. 2.

As a matter of fact, it deals with a solid piece 14 that is obtained by machining, presenting:

- a cylindrical extremity 14*a* inserted into the tube 8 with an axially drilled opening shaped to define a Venturi tube 14*b* (which is possible replaced by an attached diaphragm);
- a conical central section 14*c* whose point is turned toward the Venturi tube 14*b;*
- and an open, truncated shaped extremity 14*d* opposite to said tube 14*b,* which extremity is provided with a series of divergent channels 14*e*.

Such a two-phased distributor gives excellent results but its cost price is very high due to the machining necessary for its manufacture.

SUMMARY OF THE INVENTION

The invention has the purpose of remedying this disadvantage of cost without, however, lowering the quality of the result to be obtained.

The distributor in accordance with the present invention is especially noteworthy because it is constituted by a metal sheet shaped in the form of a spherical calotte open in direction toward the outlet of the inlet tube and that it presents a series of holes arranged around a plane central section.

Tests have shown that such an arrangement, in fact ensuring a homogeneity of the two-phase refrigerant liquid, is at least as satisfactory as the usual distributors in accordance with FIG. 2, but at a greatly reduced cost price.

It was further recognized that the most favorable results were obtained by designing the plane central section of the perforated calotte as an axially oriented cone with the point inserted into the inlet tube of the refrigerant.

BRIEF DESCRIPTION OF THE DRAWINGS

The hereto attached drawings, given by way of example, will allow a better understanding of the invention, its characteristics and the benefits it is likely to provide.

As previously mentioned, FIG. 1 shows the general structure of a customary intratubular heat exchanger, while

DESCRIPTION OF THE PREFERRED EMBODIMENT

Figure 1:
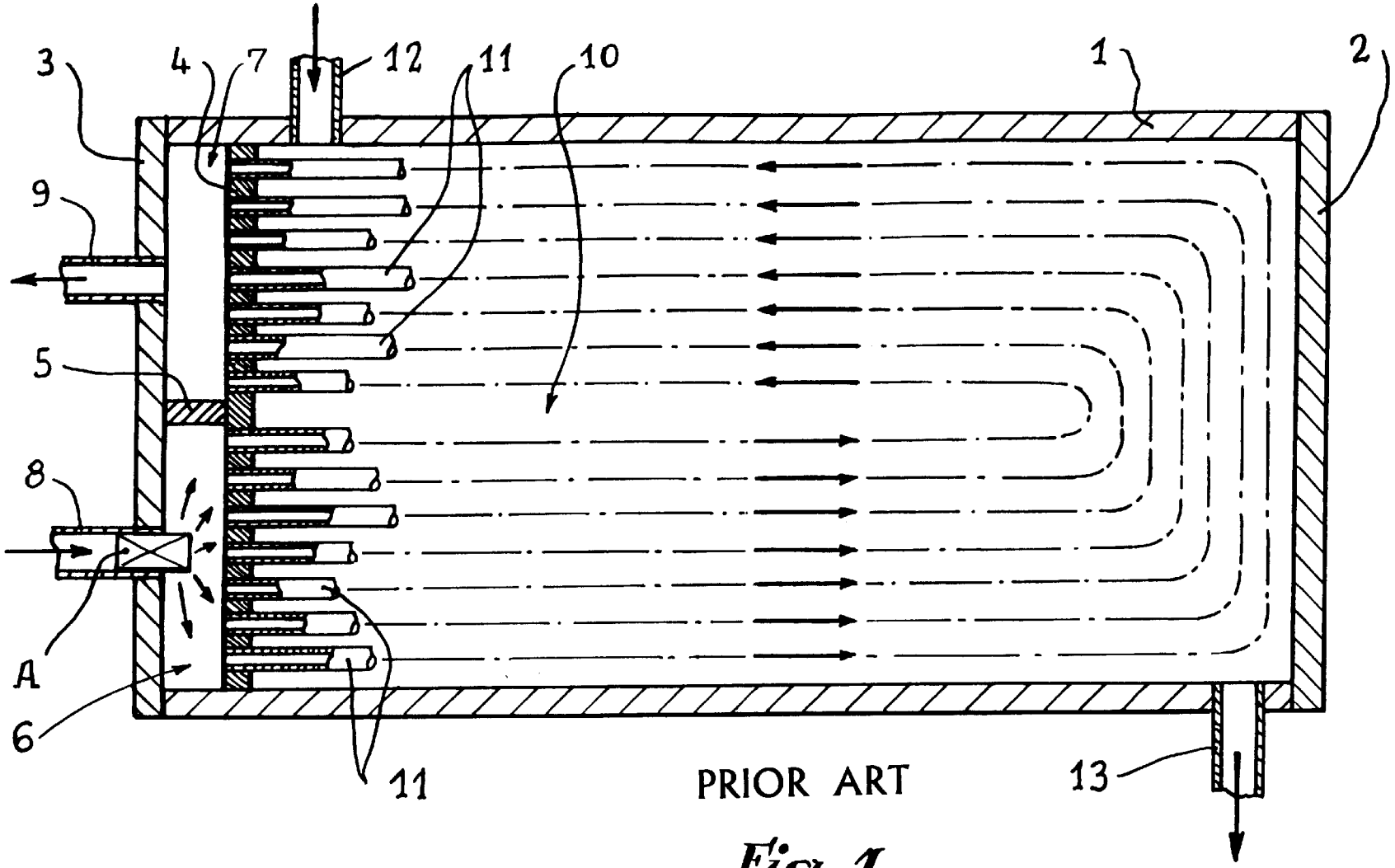
PRIOR ART Fig. 1
Figure 2:
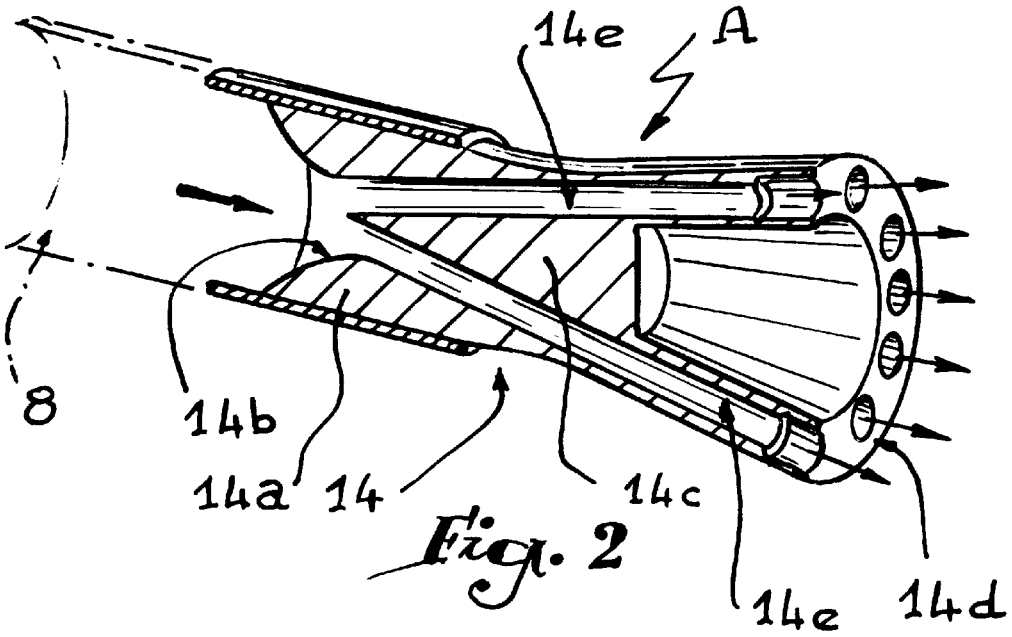
Fig. 2 PRIOR ART
FIG. 2 illustrates diagrammatically the arrangement of a two-phase flow distributor of standard type.
Figure 3:
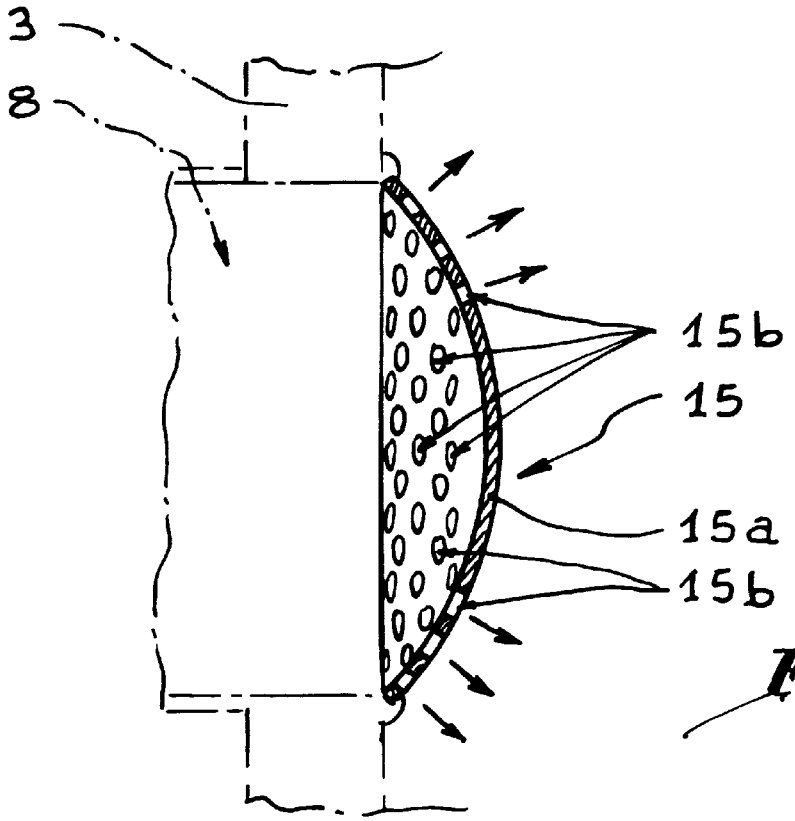
FIG. 3 is an axial section of an inlet tube provided with a distributor in accordance with the present invention.

The two-phase flow distributor illustrated in FIG. 3 is constituted by a metal sheet 15 embossed in order to form a spherical calotte. The central section 15*a* is intended to be plane while in the peripheral zone are bored holes 15*b,* that are advantageously arranged according to concentric rows, whose number depends on the diameter of the metal sheet or element 15.

This piece 15 is attached in any adequate manner (for example, by welding) at its edge to the inside wall of the end plate 3 of the exchanger, so that it is oriented following the axis of the discharge of the inlet tube 8 in the chamber 6 of said exchanger. The two-phase refrigerant that traverses under pressure this conduit 8 must pass through the holes 15*b*. The turbulances created by the hitting of this fluid against the plane central section 15*a* and by the resistance exerted by said holes at the passing of the fluid ensure the effective mixing of its two phases so that, under these circumstances, one obtains an efficacious homogenizing inside the inlet chamber 6 that fills the looped tubes 11.

Figure 4:
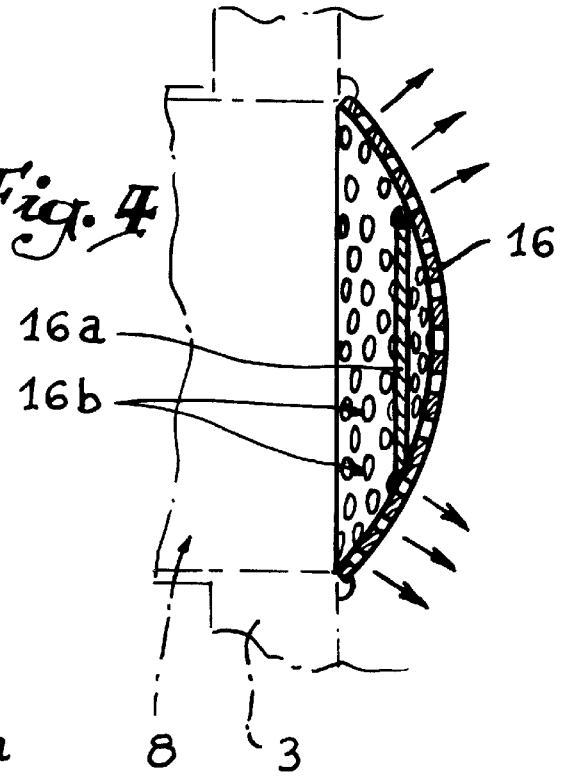
FIG. 4 illustrates in the same manner a variant of an embodiment of the distributor according to FIG. 3.

FIG. 4 illustrates a variant in which the unit of the spherical calotte, herein referenced as 16, is provided with holes 16*b,* while the plane central section is obtained by means of a plate 16*a* mounted on said calotte following a line in the axial section of FIG. 4. The obtained result is the same as the one obtained with the embodiment in accordance with FIG. 3. The costs of manufacture are considerably lower in one or the other case.

Figure 5:
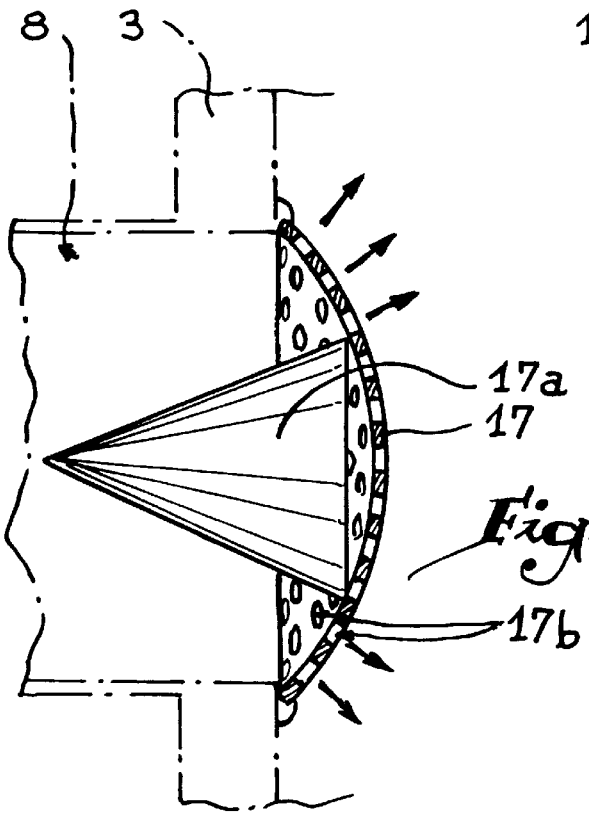
FIG. 5 illustrates a front view of a distributor designed in accordance with the preferred use of the invention.
Figure 6:
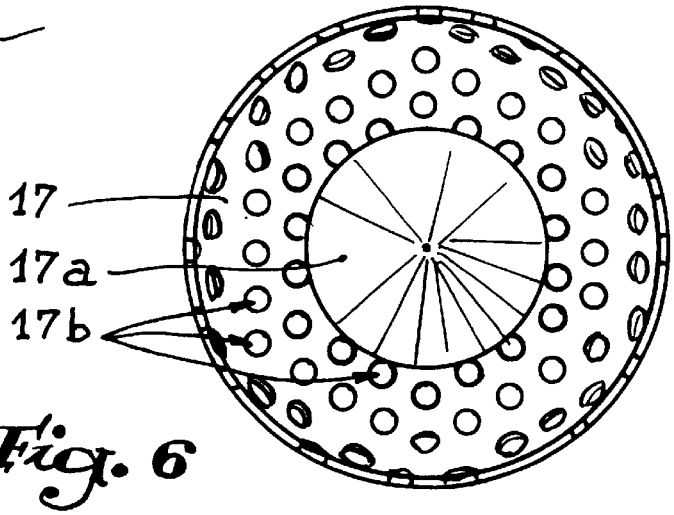
FIG. 6 illustrates an axial section of the distributor in accordance with FIG. 5.

The homogenizing of the two-phase refrigerant is markedly improved if one adopts the embodiment illustrated in FIGS. 5 and 6. Therein, the spherical calotte 17 is provided with holes 17*b* over its entire surface, as in FIG. 4, and the plane central section is obtained by mounting inside of said calotte 17 not a plane piece or plate but a conical body 17*a,* the point of which is inserted into the tube 8. The conical body 17*a* furthers the bursting of the refrigerant and its dividing in direction to the perforated peripheral zone.

In an advantageous manner, the conical body 17*a* is provided on its outside surface with grooves that extend parallel to the axis of this body 17*a,* that is to say, parallel to the direction of the flow of the fluid in the tube 8.

These not illustrated grooves allow the filling of the zone behind the base of the cone, between the latter and the spherical calotte 17.

These grooves extend at least between the base of the cone and the discharge of the inlet tube of the fluid.

What we claim is:

1. A distributor for the filling of intratubular heat exchangers of cooling installations with a two-phase type refrigerant, of a type to be mounted at the outlet of an inlet tube of the refrigerant inside a chamber (6) that fills exchange tubes (11), comprising a metal sheet (15, 16, 17) shaped as an pen spherical calotte in a direction toward an outlet of a tube (8) presenting a series of holes (15*b,* 16*b,* 17*b*) arranged around a plane central section (15*a,* 16*a,* 17*a*); wherein said plane central section is delimited by a flow enhancing structure mounted at a bottom of said spherical calotte.

2. A distributor in accordance with claim 1, wherein said flow enhancing structure is a plane plate (16*a*).

3. A distributor in accordance with claim 1, wherein said flow enhancing structure is a conical-shaped body (17*a*) having a point which is inserted into the inlet tube (8).

4. A distributor in accordance with claim 3, wherein said conical-shaped body (17*a*) is provided at its outside surface with grooves that extend parallel to an axis of said body (17*a*).

* * * * *